US011116679B2

(12) United States Patent
Carter

(10) Patent No.: US 11,116,679 B2
(45) Date of Patent: Sep. 14, 2021

(54) BED BOUND PATIENT TURNING DEVICE

(71) Applicant: Vandette B. Carter, Yorktown Heights, NY (US)

(72) Inventor: Vandette B. Carter, Yorktown Heights, NY (US)

( * ) Notice: Subject to any disclaimer, the term of this patent is extended or adjusted under 35 U.S.C. 154(b) by 28 days.

(21) Appl. No.: 16/219,933

(22) Filed: Dec. 13, 2018

(65) Prior Publication Data

US 2019/0175428 A1 Jun. 13, 2019

Related U.S. Application Data

(60) Provisional application No. 62/598,457, filed on Dec. 13, 2017.

(51) Int. Cl.

| | |
|---|---|
| ***A61G 7/00*** | (2006.01) |
| ***A61G 7/05*** | (2006.01) |
| ***A61G 7/008*** | (2006.01) |

(52) U.S. Cl.

CPC ..... *A61G 7/001* (2013.01); *A61G 7/05* (2013.01); *A61G 7/008* (2013.01); *A61G 2200/32* (2013.01)

(58) Field of Classification Search

CPC ..... A61G 7/001; A61G 7/008; A61G 7/05; A61G 7/1023; A61G 7/1026; A61G 7/103; A61G 7/1034; A61G 7/1044; A61G 7/1053; A61G 2200/32; A61G 1/044

See application file for complete search history.

(56) References Cited

U.S. PATENT DOCUMENTS 1,334,901 A * 3/1920 Higdon ..... A61G 7/1026 5/500
2,535,559 A * 12/1950 Wolf ..... A61G 13/12 5/630
3,485,240 A * 12/1969 Fountain ..... A61G 7/001 601/148
3,862,454 A * 1/1975 Mazzucconi ..... A47C 17/162 5/47
3,962,736 A * 6/1976 Fedele ..... A61G 1/003 5/81.1 HS
4,180,879 A * 1/1980 Mann ..... A61F 5/3784 128/872
4,934,002 A * 6/1990 Watanabe ..... A61G 7/008 5/425
4,987,621 A * 1/1991 Brantman ..... A61G 7/103 193/35 R
5,060,324 A * 10/1991 Marinberg ..... A61B 6/0442 128/873
5,092,007 A * 3/1992 Hasty ..... A61G 7/001 5/691

(Continued)

*Primary Examiner* — David R Hare
(74) *Attorney, Agent, or Firm* — Ohlandt, Greeley, Ruggiero & Perle, L.L.P.

(57) ABSTRACT

A device in the shape of an arc, having a curvature of ideally 180 degrees and 12 inches or less width, can be comprised of one or more parts, engineered in such a way to facilitate the effortless turning and positioning of a bedbound patient—who is otherwise unable to maneuver or turn under his or her own strength when positioned within the arc. The arc is equipped with adjustable levers and harnesses so as to secure the patient within and prevent the device from moving when movement is not required. The device is configured with mechanical means to facilitate turning of the patient when required.

23 Claims, 5 Drawing Sheets

(56) References Cited

U.S. PATENT DOCUMENTS 5,165,122 A * 11/1992 Phalen ..... A61G 7/1026 5/81.1 T
5,500,964 A * 3/1996 Bergersen ..... A61G 7/001 5/607
5,530,974 A * 7/1996 Rains ..... A47C 21/08 5/630
5,640,729 A * 6/1997 Marino ..... A61G 7/001 5/607
5,704,081 A * 1/1998 Bollinger ..... A61G 7/1026 5/81.1 T
5,735,002 A * 4/1998 Kistner ..... A61G 7/103 5/81.1 HS
5,833,291 A * 11/1998 Haugs ..... A61G 7/001 294/119.3
6,073,279 A * 6/2000 Skaler ..... A61G 7/001 5/81.1 R
6,230,342 B1 * 5/2001 Haugs ..... A61G 7/001 5/607
6,233,766 B1 * 5/2001 Ohman ..... A61G 1/01 5/627
6,560,793 B2 5/2003 Walker
7,246,389 B2 * 7/2007 Taguchi ..... A61G 7/001 5/608
7,716,761 B1 * 5/2010 Gilstad ..... A61G 7/0573 5/425
8,025,614 B2 * 9/2011 Newburger ..... A63B 21/065 482/130
8,261,380 B2 * 9/2012 Ferraresi ..... A61G 7/1019 5/607
8,601,619 B2 * 12/2013 McNulty ..... A61G 7/1032 5/81.1 C
8,713,729 B2 * 5/2014 Malakhov ..... A61G 7/07 5/607
8,789,533 B2 * 7/2014 Steffens ..... A61G 7/001 128/845
9,339,407 B2 * 5/2016 Bhat ..... A61F 5/00
9,486,379 B2 * 11/2016 Fallouh ..... A61G 13/12
10,071,007 B2 9/2018 Williams et al.
10,258,527 B2 * 4/2019 Rodriguez ..... A61G 7/1023
2001/0047543 A1 * 12/2001 VanSteenburg ..... A61G 7/103 5/81.1 C
2005/0103350 A1 * 5/2005 Henry ..... A61G 7/1026 128/869
2006/0016007 A1 * 1/2006 Hornbach ..... A61G 7/05769 5/607
2008/0222811 A1 * 9/2008 Gilbert ..... A61G 13/04 5/607
2010/0275370 A1 * 11/2010 Van Loef ..... A61G 7/1038 5/81.1 R
2013/0180530 A1 * 7/2013 Choi ..... A61G 5/10 128/889
2013/0255699 A1 * 10/2013 Squitieri ..... A61F 5/34 128/892

* cited by examiner

BED BOUND PATIENT TURNING DEVICE

This application claims priority from and the benefit of provisional application Ser. No. 62/598,457 filed on Dec. 13, 2017, the entire contents of which is incorporated herein by reference, it its entirety.

BACKGROUND OF THE DISCLOSURE

1. Field of the Disclosure

The present disclosure relates to bedbound patient turning devices, used to prevent decubitus ulcer formation and to promote bedsores healing.

2. Description of the Related Art

It is common knowledge that a person can be comatose or hospitalized for weeks, months or even years, for one reason or another; often supported by life sustaining measures, such as a ventilator and blood pressure pharmacologic agents. These patients often end up losing limbs or acquiring blood borne infections, as a result of immobility that follows a well defined course; beginning with skin degradation/destruction to the muscles, fascia and bones, with microbes invading the lymphatic and circulatory system, resulting in incurable infection and subsequent death of the host.

Repeated life threatening infections become the norm, once the skin is compromised beyond a stage III ulcer. Bedsores often develop as a result of a combination of shearing forces, the effects of gravity of the body, skin integrity of poor quality, inadequate nutrition and poor hygiene, are all well known causative factors. The formation of decubitus ulcer is therefore multifactorial with "pressure" from immobility being a significant contributor.

There have been dozens of inventions developed (and in use), intended to address, prevent or ameliorate the aforementioned predisposing causes of bedsores. Regrettably the disease course still goes unchecked, leading to thousands of patients requiring long term 'total care'; amputations, multiple rounds of debridement and repeated antibiotic course—not to mention numerous MRI scans and x-rays imaging to assess the extensiveness of the condition.

Since the patient as described often requires total care, a great physical toll is also taken on the nursing staff (caregiver/provider), tasked with the duty of turning and positioning a disabled patient, every two hours around the clock—an impossible feat, when undertaken by any one person.

Though many forms of automatic and pneumatic bed ulcer devices are already on the market, none of them have proven exceptionally superior, to prevent or cure bed ulcers by any appreciable measure. Bedsores frequency and incidences have not been curbed in recent years, despite numerous devices created to abate the ailment.

The work force of nurses tasked to care for bedbound patients often suffer back and upper extremity injuries when attempting to turn a disabled patient, with or without the aide of "specialized mattress" or turning devices such as U.S. Pat. Nos. 10,071,007 and 6,560,793. The task often requires two persons to turn a patient, taking a toll on human resources, expending much energy and time. For one reason or another, it is not effortless or practical for a caregiver to turn and position a patient every 1-2 hour, to prevent decubitus ulcer formation; as such, decubitus ulcer remains a frequently encountered medical condition in acute and long term care facilities.

What is needed to ameliorate and eradicate this endemic problem of bedsores is a device that may allow one person to turn and position a patient, at any time, without using much effort or time.

SUMMARY OF THE DISCLOSURE

In general, it is a primary object of the first embodiment disclosed herein to be simple in design, lightweight and sturdy, while still having superior functionality to accomplish the task of turning and positioning of a bedbound patient with relative ease.

It is a further objective of the invention to accomplish the aforementioned task from the effort of one person and not requiring multiple caregivers to turn a patient.

To achieve the requirements set forth, the invention encapsulates the benefit of the wheel and lever into its architecture, thereby giving it the benefits and property of both technologies, embodied into one simple, esthetically pleasing and ergonomic device.

It is a further objective of the invention to be affordable. Yet still, a further objective of the invention is to permit the virtually effortless turning of a patient by applying very minimal physical force, by pushing or pulling, reducing or eliminating the likelihood of back or muscular skeletal injuries of the caregiver.

In another embodiment, the bottom of the device (not shown) is equipped with pneumatic inflatable system (compartments), to permit the turning of a patient from left to right and vice versa. As the inflatable component expands on the left side of the arc, the arc will pivot towards the right side; simultaneously, the right component will deflate, to facilitate turning. To turn the patient to the right side, the left side of the device will inflate, while the right side (below the arc) will deflate. A timer is associated with this embodiment to promote the alternating pivoting of the arc from left to right and vice versa. Hydraulic means may be used instead of air to achieve said objective of automatically turning the patient from one side to another remotely or at the patient's bedside. Remote operation can be facilitated by connection to a wireless network.

An embodiment of the disclosure is directed to a bed apparatus constructed to retain the benefit of the first embodiment and to achieve the benefit thereof. The bed has an arcuate configuration, to promote the effortless turning of the patient, from left to right side and vice versa. The bed may be powered by an electric motor or hydraulic means.

BRIEF DESCRIPTION OF THE DRAWINGS

A component or a feature that is common to more than one drawing is indicated with the same reference number in each of the drawings.

DESCRIPTION OF THE EMBODIMENTS

Figure 1:
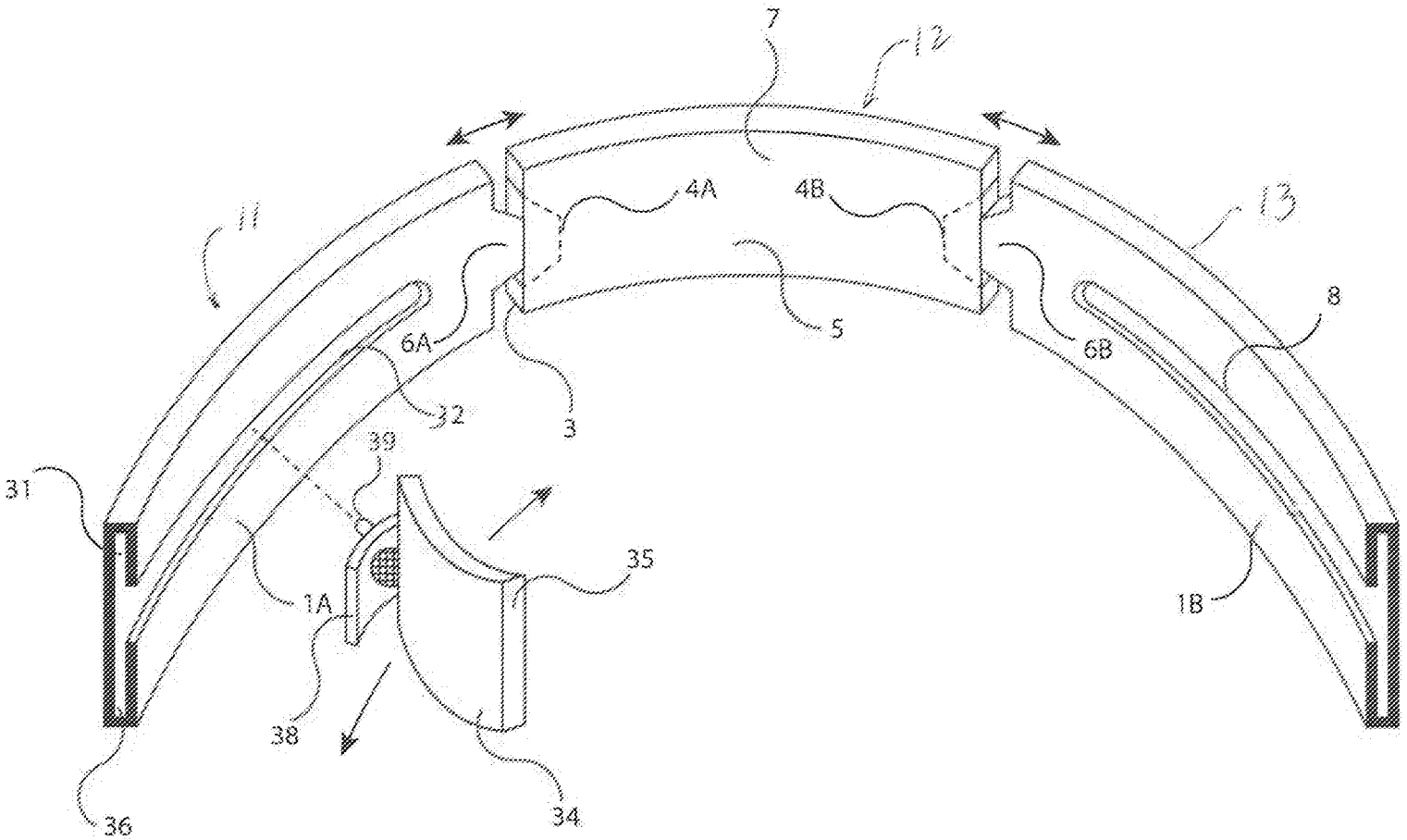
FIG. 1 is a perspective view of a first embodiment of the apparatus disclosed herein.

In FIG. 1, an arcuate apparatus is depicted having three interconnecting parts shown generally as sections 11, 12 and 13, which may form a half circle, over an arc of approximately 180 degrees. However, two interconnecting parts could be used, or just one part, as may be best suited for packaging, application and assembling in the field.

Figure 3:
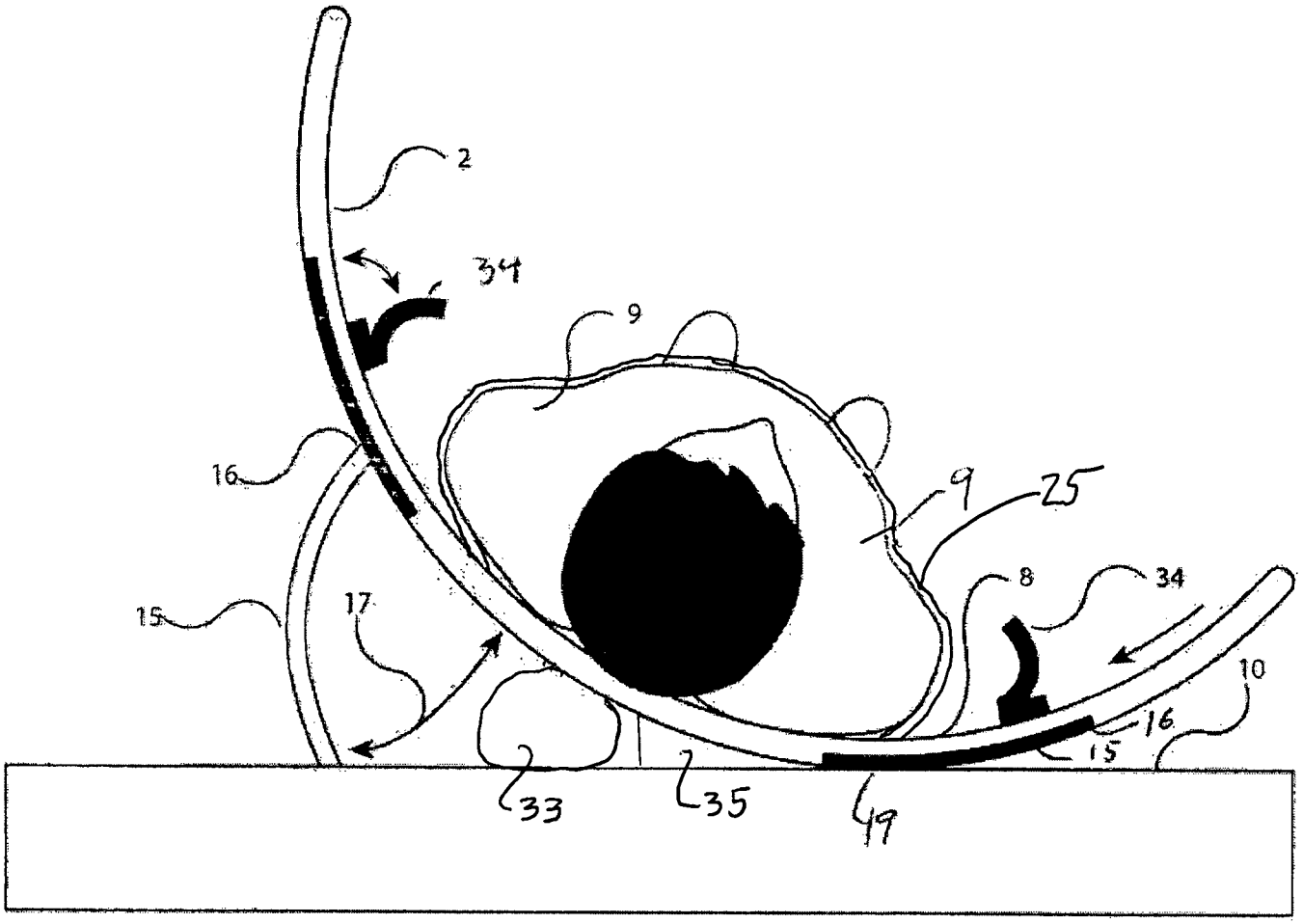
FIG. 3 is an end view of the apparatus of FIG. 1 in use with a patient with the patient being rolled towards the right side of the patient.
Figure 5:
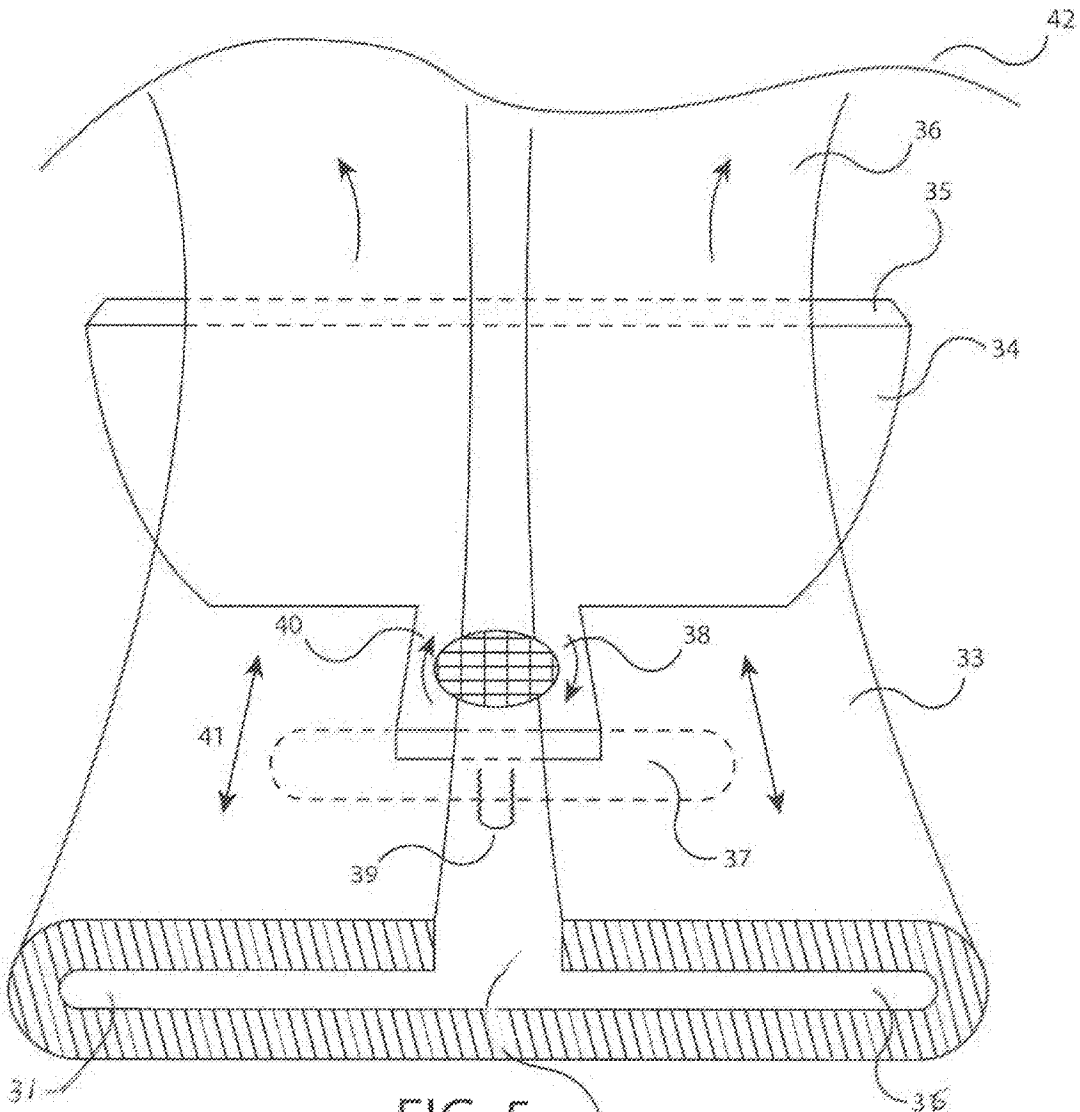
FIG. 5 is a cross sectional perspective view of a manipulating member attached to the apparatus of FIG. 1.

Referring also to FIG. 5, section 11 of the arc has a pair of inner tracks 31 and 36 with an opening 32 on the inner surface, to receive a sliding member 38, which is used to secure a patient in place, for example, at the shoulders of the patient, as suggested by FIG. 3.

Section 11 has a protrusion, in the form of an interconnecting part 6A, which can be inserted into a recess 4A in section 12, in a releasable manner, to optionally be locked in place, to secure part 6A within recess 4A of section 12. Section 13 has an inner track 8, which may also receive an adjustable fastener/clamp 38 having a protrusion 39.

The ends 1A and 1B of sections 11 and 13 effectively serve as handles to permit the downward or upward movement of the respected two ends in the manner of a lever as demonstrated in FIG. 3.

Figure 2:
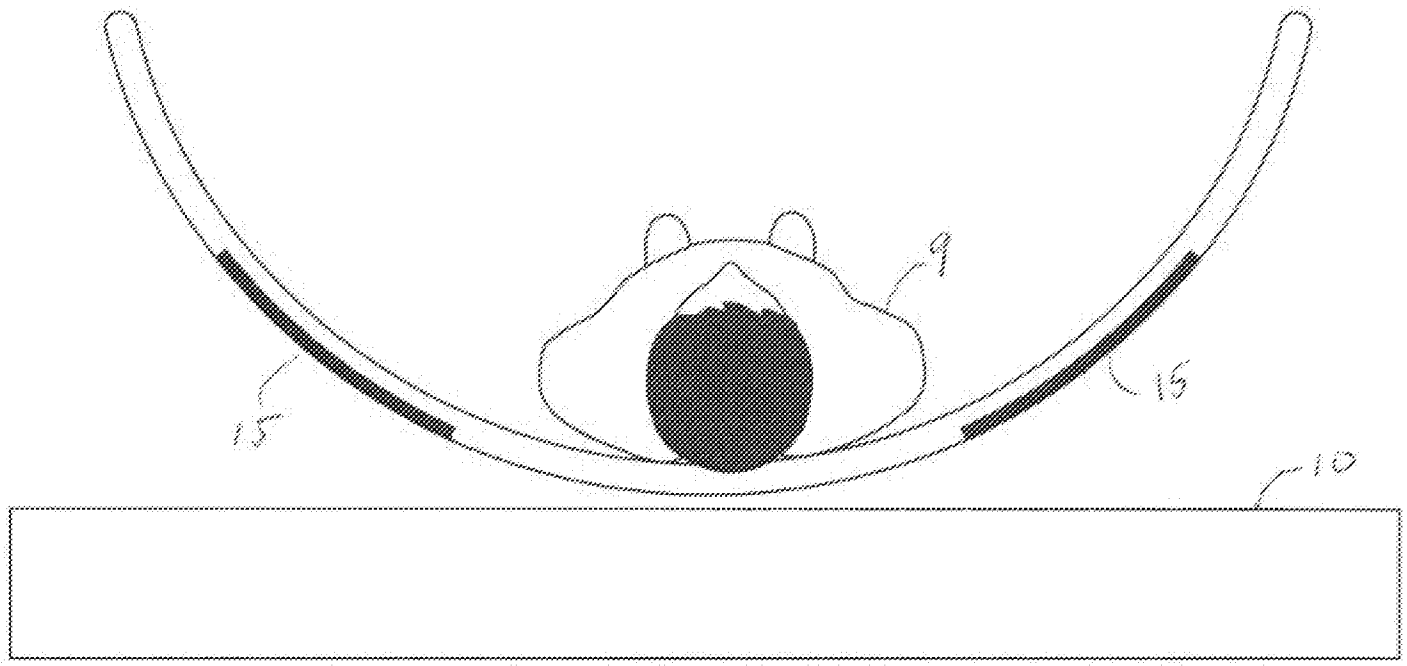
FIG. 2 is an end view of the apparatus of FIG. 1 in use with a patient in a supine position.

FIGS. 2 and 3 depicts the apparatus in use, showing a patient/subject 9, situated thereupon from a cross section viewpoint. In FIG. 3, the device is situated upon a typical bed 10, whereby the arcuate apparatus makes contact with the bed at fulcrum point 19.

In FIG. 3, the inner surfaces of the apparatus are shown as 2 and 8. The arcuate device may be pushed upwards by manual means at location 2 to position the surface 8 horizontal to the bed, assuming a downward position.

The arcuate apparatus may be placed first under the patient's upper back/shoulder area by rotating the patient's upper body, to approximately 45 degrees, by extending and apply traction to one arm in the contralateral direction, with the patient's arm crossing their chest. The device may be inserted by positioning areas 5 and 7 (FIG. 1) between the scapulae, while exposing one of the receiving ends 4A or 4B for the insertion of section 6B or 6A.

When the first section of the apparatus is in place, the patient's other arm can be rotated and extended in the opposite direction, to fit the opposite end of the device into place, to create a full 160 to 240 degrees arc, under the patient's upper back region.

Simultaneously, the lower back, hips or thigh can be fitted with another device of similar design and size and also approximately twelve inches width, so as to have two devices situated under the patient to further reduce the workload required to turn a patient. Further still, the device may exist in different sizes, to accommodate a pediatric or bariatric individual. The first device may have a width to fit under T-1 to T-6; T7-T12 or T12 to L5 spinal regions. The intervals are usually six inches or less for an adult person, male or female.

In FIG. 3, the first embodiment is shown with a portion of the apparatus at lowest position 19 on a bed structure, such as a mattress of bed 10, with a patient subject 9 situated therein. As shown in FIG. 2 and in more detail in FIG. 5. supporting arm 34 may extend approximately 90 degrees from a closed position from within the inner aspect of the arc, 2. The extendable arm may slide backward and forward 41, within the track 31 and 36 on either side of the device and locked into place by clamp and screw mechanism 37, 38, 39 and 40, as shown in FIG. 5.

A built-in stand 15 is extendable into an opened position 17, in order to support the orientation of the patient subject 9, to lean or be positioned on one side of his/her body. In the illustration of FIG. 3, the subject is leaning towards the right when a force 18 is applied upward at the opposite end of the disclosed apparatus. A hinge support is at location 16 which will allow for the extension and retraction of the stand 15, to support the main structure in a turned position, as in FIG. 3. The apparatus can be configured so that the stand is seamless and continuous with the outer contour of the device. The function of stand 15 may be provided by instead using pillows 33 or wedges 35 to support the apparatus in a position as show in FIG. 3, or so that the patient is rolled toward the left. The patient may be secured by a harness 25.

Figure 4:
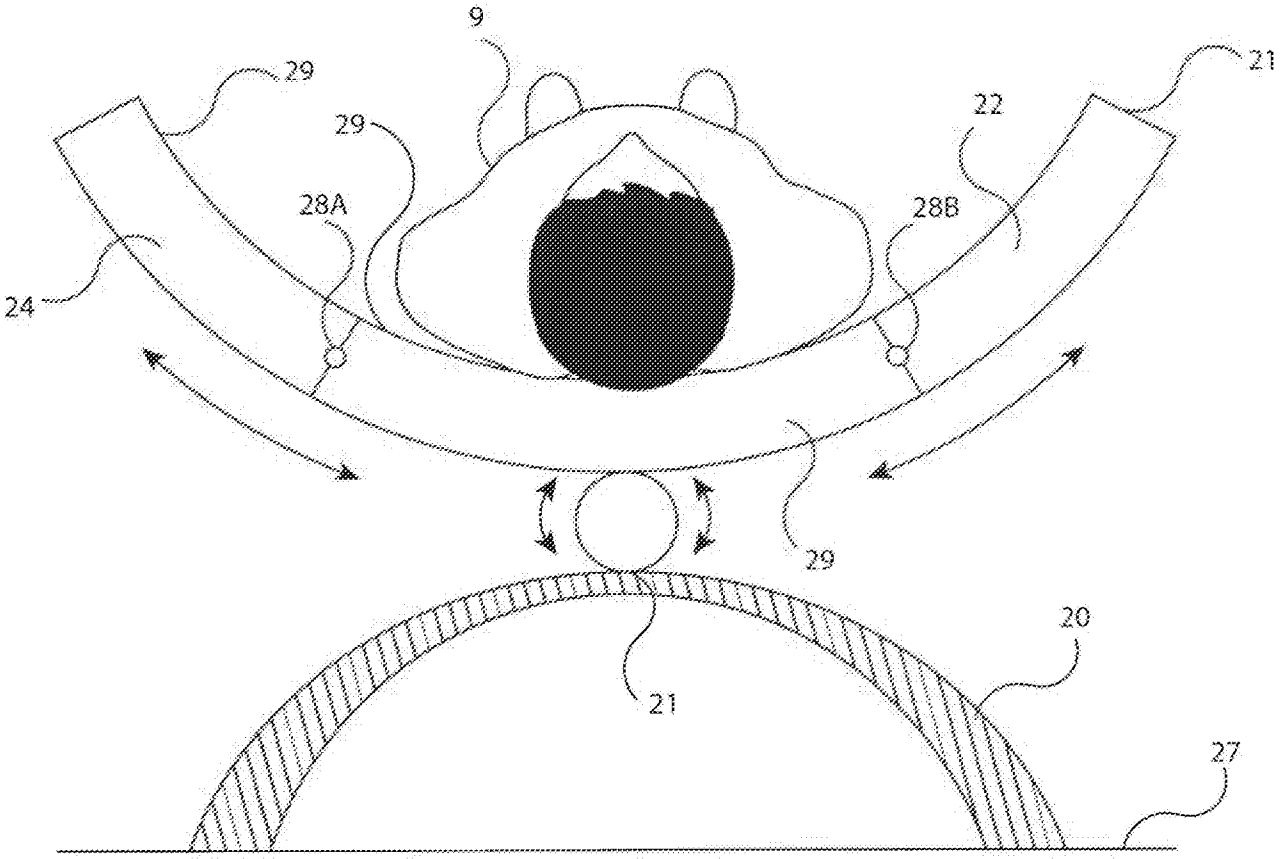
FIG. 4 is an end view of an embodiment of the disclosed apparatus configured as a bed.

FIG. 4 shows a cross section of the second embodiment which is an arcuate bed 21 having the ability to pivot to the left side 24 or right side 23 when subjected to the clockwise or anticlockwise turn of an electric motor or gear wheel 26. Though the turning mechanism is easily achievable with an electric motor, hydraulic means can be employed to permit the movement in all plains, to allow Trendelenburg positioning (supine with the head raised and reverse Trendelenburg positioning with the head lowered). Further the outermost parts of the arcuate bed 21 may be removable or folded downwards, 28A and 28B. A support member 20 situated on a solid surface 27.

Though the inventions are shown generally as arcuate semicircles, any geometric shapes can be adapted to achieve similar results, without departing from the spirit of the invention. For example, the arc may be constructed in three segments, to have a subtended angle of 30-60 degrees for each segment, when assembled. The arc may have a soft and moldable material on the inner surface that makes contact with the patient's skin, while the outer curvature may be constructed of a ridged and inflexible material having a smooth surface. The moldable material can be bacteriostatic and able to withstand standard sterilizing cleaning agents that are bactericidal, without altering its property or usefulness.

Moreover the three segments may be utilized or engineered as one continuous embodiment having a curvature of over an angle of 180-240 degrees, or less than 180 degrees (for example, 120-160 degrees).

The techniques described herein are exemplary, and should not be construed as implying any particular limitation on the present disclosure. It should be understood that various alternatives, combinations and modifications could be devised by those skilled in the art. For example, steps associated with the processes described herein can be performed in any order, unless otherwise specified or dictated by the steps themselves. The present disclosure is intended to embrace all such alternatives, modifications and variances that fall within the scope of the appended claims.

The terms "comprises" or "comprising" are to be interpreted as specifying the presence of the stated features, integers, steps or components, but not precluding the presence of one or more other features, integers, steps or components or groups thereof.

What is claimed is:

1. An apparatus for turning a patient comprising:

an arcuate member on which at least a portion of the patient is supported, wherein the arcuate member is comprised of three separate sections which are assembled to form the arcuate member;

a portion of said arcuate member being for manipulation by a caregiver for rolling the arcuate member to thereby reposition the arcuate member so that force of the patient's weight is redistributed to different portions of the arcuate member and to different locations on the patient's body; and at least one of a motor, a gear or a hydraulic system for moving the apparatus to a position other than one in which the weight of the patient is supported solely by pressure on a back of the patient.

2. The apparatus of claim 1, wherein a first section is a central section having a first aperture at one end and a second aperture at another end, wherein a second section has a first projection for being received in the first aperture and a third section has a second projection for being received in the second aperture.

3. The apparatus of claim 1, wherein a first section is a central section, a second section is assembled to one end of the central section and a third section is assembled to another end of the central section.

4. The apparatus of claim 3, wherein the second section and the third section each have a slot extending away from the central section, and an opening in the respective slots extending along an inner surface of the arcuate member.

5. The apparatus of claim 1, further comprising at least one stand for supporting the apparatus when the apparatus is rolled to a position other than one in which the weight of the patient is supported solely by pressure on the back of the patient.

6. The apparatus of claim 5, further comprising a hinge for each of the at least one stand, for allowing the stand to pivot between a position against an outer surface of the apparatus, to an extended position for supporting the apparatus.

7. The apparatus of claim 6, configured with recesses for receiving the at least one stand when a respective stand is positioned against the outer surface of the apparatus.

8. The apparatus of claim 1, wherein the arcuate member subtends an arc of between 120 degrees and 240 degrees.

9. The apparatus of claim 1, wherein the arcuate member subtends an arc of substantially 180 degrees.

10. The apparatus of claim 1, wherein the arcuate member subtends an arc of a circle having a diameter of substantially thirty six inches.

11. The apparatus of claim 1, wherein the arcuate member has a width along a length of a body of the patient of approximately twelve inches.

12. The apparatus of claim 1, in combination with at least one of a pillow or a wedge for keeping the apparatus in a position other than one in which the weight of the patient is supported solely by pressure on the back of the patient.

13. The apparatus of claim 1, configured as part of a bed in which the patient is supported on the arcuate member.

14. The apparatus of claim 1, further comprising a timer for activating the at least one of a motor, a gear or a hydraulic system to periodically reposition the arcuate member.

15. The apparatus of claim 1, configured as part of a bed in which the patient is supported on the arcuate member, the bed being configured to support the patient in at least one of the Trendelenburg or reverse Trendelenburg positions.

16. The apparatus of claim 1, further comprising a harness for the patient for securing the patient to the arcuate member.

17. The apparatus of claim 1, further comprising a soft and moldable bacteriostatic material on an inner surface of the arcuate member that makes contact with the patient's skin.

18. The apparatus of claim 1, in combination with an additional apparatus comprising;

an arcuate member on which at least a portion of the patient is supported; and a portion of said member being for manipulation by a caregiver for rolling the arcuate member to thereby reposition the arcuate member so that force of the weight of the patent is redistributed to different portions of the arcuate member and to different locations on the body of the patient;

wherein the apparatus of claim 1 and the additional apparatus are positioned at different points along the length of the body of the patient to assist in repositioning the patient.

19. An apparatus for turning a patient comprising:

an arcuate member on which at least a portion of the patient is supported, the arcuate member being comprised of three sections which are assembled to form the arcuate member, wherein a first section is a central section, a second section is assembled to one end of the central section and a third section is assembled to another end of the central section;

the second section and the third section each have a slot extending away from the central section, and an opening in the respective slots extending along an inner surface of the arcuate member;

a portion of said arcuate member being for manipulation by a caregiver for rolling the arcuate member to thereby reposition the arcuate member so that force of the patient's weight is redistributed to different portions of the arcuate member and to different locations on the patient's body.

20. The apparatus of claim 19, further comprising:

a respective supporting arm movable along each of the slots for supporting a side of the patient.

21. The apparatus of claim 19, wherein the respective supporting arms are configured to support at least one of a shoulder and arm of the patient.

22. The apparatus of claim 19, further comprising clamp and screw mechanism for securing the supporting arms at positions along respective slots.

23. The apparatus of claim 19, further comprising at least one of a motor, a gear or a hydraulic system for moving the apparatus to a position other than one in which the weight of the patient is supported solely by pressure on a back of the patient.

* * * * *